US009078307B2

(12) United States Patent
Yao et al.

(10) Patent No.: US 9,078,307 B2
(45) Date of Patent: Jul. 7, 2015

(54) FAULT PROTECTION SYSTEM AND METHOD FOR FLUORESCENT LAMP BALLASTS

(71) Applicant: General Electric Company, Schenectady, NY (US)

(72) Inventors: Gang Yao, Mayfield Heights, OH (US); James Domenic Mieskoski, Seven Hills, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 196 days.

(21) Appl. No.: 13/723,281

(22) Filed: Dec. 21, 2012

(65) Prior Publication Data

US 2014/0175982 A1 Jun. 26, 2014

(51) Int. Cl.

| | |
|---|---|
| ***H05B 37/02*** | (2006.01) |
| ***H05B 37/03*** | (2006.01) |
| ***H05B 41/298*** | (2006.01) |

(52) U.S. Cl.

CPC ..... *H05B 37/03* (2013.01); *H05B 41/2981* (2013.01)

(58) Field of Classification Search

CPC .... H05B 37/02; H05B 37/03; H05B 41/3921; H05B 41/3925; H05B 41/282; H05B 41/2981; Y10S 315/04; Y10S 315/07

USPC ..... 315/209 R, 224, 247, 291, 244, 307, 315/308, DIG. 4, DIG. 7

See application file for complete search history.

(56) References Cited

U.S. PATENT DOCUMENTS

| | | | | |
|---|---|---|---|---|
| 4,523,131 | A | 6/1985 | Zansky | |
| 5,691,605 | A * | 11/1997 | Xia et al. | 315/307 |
| 5,757,142 | A | 5/1998 | Kong | |
| 6,008,592 | A * | 12/1999 | Ribarich | 315/225 |
| 6,175,198 | B1 | 1/2001 | Nerone | |
| 6,281,641 | B1 * | 8/2001 | Chen et al. | 315/307 |
| 6,339,298 | B1 * | 1/2002 | Chen | 315/224 |
| 6,504,315 | B2 * | 1/2003 | Kim | 315/224 |
| 6,642,669 | B1 | 11/2003 | MacAdam et al. | |
| 6,693,393 | B2 * | 2/2004 | Konishi et al. | 315/224 |
| 6,696,803 | B2 | 2/2004 | Tao et al. | |

(Continued)

OTHER PUBLICATIONS

Industry Applications Conference, 1997. Thirty-Second IAS Annual Meeting, IAS '97., Conference Record of the 1997 IEEE; High Efficiency, Low Stress Electronic Dimming Ballasts for Multiple Fluorescent Lamps;Issue Date : Oct. 5-9, 1997, pp. 2380-2387, vol. 3, ISSN : 0197-2618.

*Primary Examiner* — Haiss Philogene

(74) *Attorney, Agent, or Firm* — GE Global Patent Operation; Peter T. DiMauro

(57) ABSTRACT

Provided is a lighting ballast system and method for fluorescent lamps. The system and method utilize a lamp current control loop to control the light level of a fluorescent lamp. The ballast includes an open loop detector that recognizes an open current control loop as an indication of a fault or hazard condition, and causes the ballast to output a safe lamp voltage or no voltage. The fault or hazard condition may be, for example, a very high voltage at the lamp or very low current across the lamp. The ballast also includes a disable circuit that prevents the open loop detector from triggering at times when the loop is expected to be open such as during ignition and maintenance restarting of the lamp.

9 Claims, 6 Drawing Sheets

(56) References Cited

U.S. PATENT DOCUMENTS

| | | | | |
|---|---|---|---|---|
| 6,700,331 | B2 | 3/2004 | Benensohn | |
| 7,030,570 | B2 * | 4/2006 | Alexandrov | 315/224 |
| 7,489,090 | B2 * | 2/2009 | Taipale | 315/307 |
| 8,212,498 | B2 | 7/2012 | Nerone | |
| 8,384,310 | B2 * | 2/2013 | Nerone | 315/307 |
| 8,598,806 | B2 * | 12/2013 | Li et al. | 315/291 |
| 2011/0316428 | A1 | 12/2011 | Li et al. | |
| 2012/0086353 | A1 | 4/2012 | Nerone | |

* cited by examiner

FAULT PROTECTION SYSTEM AND METHOD FOR FLUORESCENT LAMP BALLASTS

I. FIELD OF THE INVENTION

The present invention relates generally to ballasts for fluorescent lamps. More particularly, the present invention relates to ballasts for fluorescent lamps that recognize lamp end of life (EOL) or open circuit conditions.

II. BACKGROUND OF THE INVENTION

Due to safety considerations, regulatory requirements for T5 and smaller diameter fluorescent lamps require that the lamp output power be limited in the case of end of lamp life (EOL) events. For example, at EOL one of the lamp filaments may cease to significantly emit electrons thereby causing the lamp to conduct in one direction but not in the opposite direction. During this condition, the lamp is said to be rectifying and may present a fault or hazard condition due to a high voltage.

A known method of providing EOL protection for a rectifying lamp is to include a detection capacitor in series with the lamps, and to sense the direct current (DC) voltage across the detection capacitor. In normal operation, the voltage across the detection capacitor will be near zero because the lamp currents are equal in both polarities. At EOL, if the lamp is rectifying, a DC voltage will accumulate across the detection capacitor, and the EOL condition can be sensed via the DC voltage. However, other fault conditions for a fluorescent lamp may result in no lamp current conduction in either direction, such as when the lamp glass envelope is cracked and the atmosphere of the lamp is lost. In this case, the rectification detection capacitor discussed above will not detect the fault. Accordingly, other methods must be used to detect the non-conducting lamp fault.

Therefore, there remains a need for a system and method that recognizes and mitigates fault and hazard conditions including lamp rectification and lamp open circuit conditions in ballasts that utilize closed loop feedback control of lamp current. There also remains a need for a system and method that recognizes and mitigates lamp faults as an open loop state in a closed loop control when a closed loop state is expected.

III. SUMMARY OF THE EMBODIMENTS OF INVENTION

Embodiments of the present invention provide a lighting system including a ballast inverter in communication with a lamp, a frequency controller, a current detector, a dimming command interface, and an amplifier.

In the embodiments, the lighting circuit is configured to control the light level, i.e., brightness or dimming, of a fluorescent lamp to a desired level. The desired light level may be, for example, a level desired by a user. The lighting circuit also detects the existence of a fault or hazard condition, and mitigates the fault or hazard condition by forcing the voltage output by the ballast to a safe level or to be cut off.

In at least one aspect, the embodiments provide a lighting system including a ballast inverter, a summing junction, a current detector, a current command interface, and an open loop detector. The ballast inverter includes a frequency controller and provides a voltage to a lamp. The summing junction is in communication with the ballast inverter and determines an error between a first output and a second output, and provides a third output to the frequency controller.

The current detector is in communication with the lamp and the summing junction and determines a current across the lamp. The current detector also provides a first output to the summing junction. The current command interface is also in communication with the summing junction and provides a second output to the summing junction. The open loop detector is in communication with the summing junction and the frequency controller, and receives the third output from the summing junction.

In operation, the open loop detector determines whether a fault or hazard condition exists within the ballast based on the third output received from the summing junction. The fault or hazard condition may include, for example, a high current at the lamp or a low current across the lamp. Upon the detection of a fault or hazard condition, the open loop detector causes the ballast inverter to output a low (safe) voltage or no voltage.

In at least another aspect, the embodiments provide a lighting system including a lamp current control loop and an open loop detector. The lamp current control loop includes a ballast inverter, a frequency controller, a current detector, a dimming command interface, and an amplifier. The ballast inverter includes a frequency controller and provides a voltage to the lamp. The frequency controller is in communication with the ballast inverter and adjusts the frequency of the ballast inverter.

The current detector is in communication with the lamp and an amplifier. The current detector determines a current through the lamp and provides a current feedback to the amplifier. The dimming command interface is in communication with the amplifier and controls the level of brightness of the lamp. The amplifier receives a first input from the current detector and a second input from the dimming command, and detects an error between the first input and the second input. The open loop detector is in communication with the amplifier and the frequency controller, and receives a third output from the amplifier.

In operation, the open loop detector determines whether a fault condition exists based on the third output. The fault or hazard condition may include, for example, a high current at the lamp or a low current across the lamp. Upon the detection of a fault or hazard condition, the open loop detector causes the ballast inverter to output a low (safe) voltage or no voltage.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

IV. BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention.

The drawings are only for purposes of illustrating preferred embodiments and are not to be construed as limiting the disclosure. Given the following enabling description of the drawings, the novel aspects of the present disclosure should become evident to a person of ordinary skill in the art.

V. DETAILED DESCRIPTION OF EMBODIMENTS OF THE PRESENT INVENTION

The following detailed description is merely exemplary in nature and is not intended to limit the applications and uses disclosed herein. Further, there is no intent to be bound by any theory presented in the preceding background or summary, or the following detailed description. Those skilled in the art with access to the teachings provided herein will recognize additional modifications, applications, and embodiments within the scope thereof and additional fields in which the invention would be of significant utility. While the embodiments are described herein with respect to dimming ballast, such as self-oscillating dimming ballast, the invention may be practiced with other ballast types including, for example, non-dimming ballasts.

Figure 1:
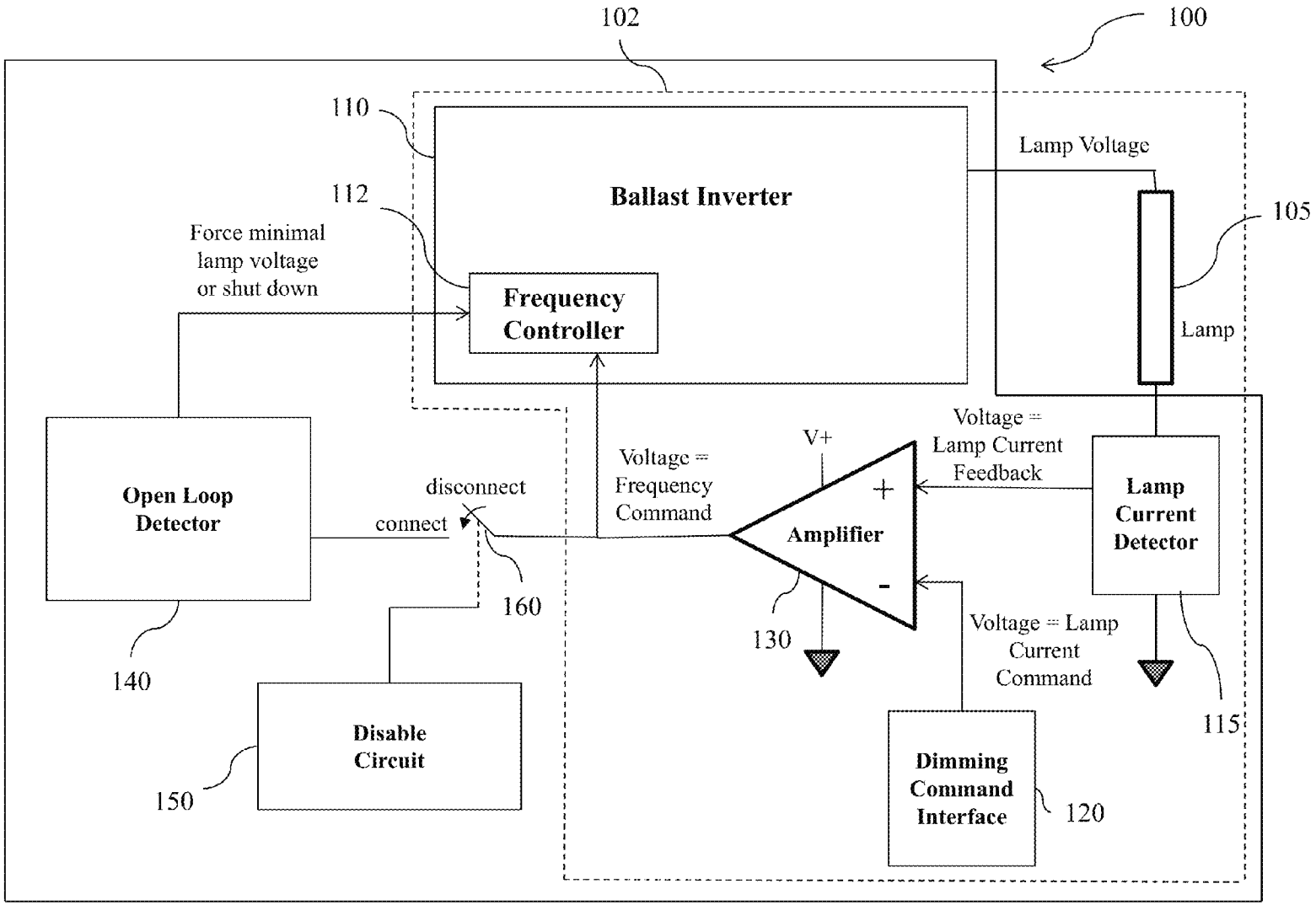
FIG. 1 is a block diagram of a lighting system in accordance with an embodiment of the present invention.

FIG. 1 is a block diagram of a dimming ballast 100 for a self-oscillating fluorescent lamp in accordance with an embodiment of the present invention. The dimming ballast 100, provides dimming for fluorescent lamp 105 and includes a ballast inverter 110 having a frequency controller 112, and a current detector 115. The dimming ballast 100 also includes dimming command interface 120, a summing junction, e.g., amplifier 130, an open loop detector 140, a disable circuit 150, and a switch 160. A lamp current control loop 102 is formed by the lamp 105, ballast inverter 110, frequency controller 112, current detector 115, dimming command interface 120, and amplifier 130.

The dimming ballast 100 utilizes the lamp current control loop 102 to control the brightness level of the lamp 105 based on the current in the lamp 105. The current control loop 102 recognizes fault conditions of the lamp 105, e.g., a lamp end of life (EOL) (such as when the lamp is rectifying), or an open circuit lamp condition (such as when no lamp is inserted in the ballast). The open loop detector 140 monitors a voltage or current within the lamp current control loop 102 and determine when the loop is open.

The state of the current control loop 102 being open is indicated by the existence of a significant error between the current command from the dimming command interface 120 and the lamp current feedback from the current detector 115. The state of the current control loop 102 being open when expected to be closed represents a fault condition at the lamp 105. Upon detection of a fault or hazard condition, the open loop detector 140 generates a signal to cause the dimming ballast 100 to shut down or to operate at a safe low power state. The disable circuit 150 disables the open loop detector 140 when it is normal for the lamp current control loop 102 to be open, e.g., when starting the lamp 105 after power-up and when a new lamp is inserted when the ballast is operated in the steady state.

Dimming command interface 120 allows the light or dimming level of the lamp 105 to be set, e.g., by a user, at a desired level of brightness. The lamp current control loop 102 regulates the current across the lamp 105 to effectively control the light level or dimming of the lamp 105. While depicted as a single element herein, the lamp 105 may include a number of connected lighting elements, and in at least some embodiments, preferably includes two series connected lamps. It should be noted that while embodiments of the present invention are discussed with respect to two series connected lamps, the embodiments will also function with parallel connected lamps. The dimming command interface 120 may be any of a variety of residential or commercial dimmer switches including, for example, a lighting dimmer switch having an adjustable (e.g., sliding or rotating) dimmer control.

The lamp 105 is powered by voltage from the ballast inverter 110. The ballast inverter 110 converts DC into alternating current (AC) and provides a current limiting function for the dimming ballast 100. The voltage output by the ballast inverter 110 varies according to a frequency of the ballast inverter 110. At low frequencies, e.g., approximately 60 KHz, the output of the ballast inverter 110 is largest. A current detector 115 determines the current across the lamp 105 and outputs a voltage to the amplifier 130.

The voltage output to the amplifier 130 by the current detector 115 can be, for example, the lamp current feedback detected by the current detector 115. The amplifier 130 receives an input from the dimming command interface 120, enabling the user to set a desired dimming level. The amplifier 130 compares the inputs from the current detector 115 and the dimming command interface 120 and outputs a voltage to the frequency controller 112. The output voltage adjusts the frequency provided to the ballast inverter 110, thereby regulating the lamp current. In this manner, the amplifier 130 forces the lamp current to equal the current command (set by the dimming command interface), thereby controlling the light level or dimming of the lamp 105.

An adverse effect of the lamp current control loop 102 is that under conditions where sufficient lamp current cannot be generated, e.g., during the EOL condition of the lamp or removal of the lamp, the control loop 102 can cause the lamp voltage to increase to unsafe levels as it attempts to equate the feedback current to the command current.

The open loop detector 140 and disable circuit 150 mitigate potential unsafe voltage levels presented by the current control loop 102. The open loop detector 140 recognizes a fault or hazardous condition, e.g., high voltage and/or low current, and forces the dimming ballast 100 to output a minimal, safe voltage, or to shut down, i.e., output no voltage. The open loop detector 140 recognizes that insufficient current is flowing in the lamp 105 and provides a control signal to the frequency controller 112.

The frequency controller 112 forces the ballast inverter 110 to output a minimal safe voltage, thereby correcting the unsafe high voltage condition presented by the current control loop 102. When the lamp 105 is started, the current control loop 102 will be open until the lamp 105 ignites and reaches a steady state. The disable circuit 150 opens switch 160 to prevent the open loop detector 140 from triggering during times when an open loop is expected, e.g. during starting (ignition) and maintenance restarting of the lamp 105. Maintenance restarting may include, for example, after a new lamp is inserted.

When the current command output by the dimming command interface 120 and the current feedback output by current detector 115 are substantially equal the difference or error output by the amplifier 130 will be minimal. In this state, the lamp current control loop 102 is said to be closed. If the current feedback cannot equal the current command due to a fault or hazard condition, e.g., the lamp is not conducting normally (due to the lamp being at EOL, and rectifying), no lamp is inserted in the ballast, the lamp has lost its atmosphere, and the like, a large error is generated by the amplifier 130.

In this state, the lamp current control loop 102 is open. The open lamp current control loop 102 causes the ballast inverter 110 to apply more voltage to the lamp 105 in order to force more current across the lamp 105. Since the current cannot be satisfied (due to the lamp 105 being at EOL and rectifying), the voltage output by the ballast inverter 110 to the lamp 105 can reach very high (unsafe) levels. The open loop detector 140 substantially prevents the unsafe voltage levels by determining the existence of an open loop state when the output (difference or error) from the amplifier 130 exceeds a determined value.

During this condition, the open loop detector 140 provides an output to the frequency controller 112 to force the ballast inverter 110 to output a low (safe) voltage or to shut down. In at least one embodiment, the ballast inverter 110 will remain in the low voltage state until the ballast 100 is either powered off and then on again, or a new lamp 105 is inserted. At this time, the ballast 100 will attempt to run again.

If the fault condition has not been cleared, the lamp current control loop 102 remains open, and the open loop detector 140 will cause the ballast 100 to continue to output a low (safe) voltage or to shut down. If the fault has been cleared, the lamp current control loop 102 will be closed. The open loop detector 140 will determine that the lamp current control loop 102 is closed and allow the ballast 100 to operate in the normal state.

The disable circuit 150 communicates with the open loop detector 140, and disables the open loop detection function at times when the lamp current control loop 102 is expected to be open. The lamp current control loop 102 is expected to be open, for example, during power up starting of the ballast 100 until the lamp 105 is in a steady state, or during lamp maintenance starting when a new lamp 105 is inserted into the ballast 100 and must be started by a momentary high voltage output by the ballast 100.

It is noted that while the embodiments shown and described herein include an operational amplifier, e.g., operational amplifier 130, other embodiments are envisioned that include alternative summing junctions. Exemplary summing junctions provide an error between the current detector and dimming command in the closed loop control system. The error may be output, for example, to a gain function that multiplies or amplifies the difference of the summing junction inputs, and provides a frequency command to the frequency controller in order to adjust the voltage output by ballast inverter. Further, instead of the actual lamp current being detected, some implementations may use a pseudo-lamp current detection (i.e., a current in the ballast other than lamp current varies in accordance with lamp current). A pseudo-lamp current may include, for example, the current across the primary coil of a transformer that is substantially equal to or proportional to the current across the secondary coil of the transformer that drives the fluorescent lamp. The pseudo-lamp current may be detected at the primary coil of the transformer to provide the lamp current feedback.

Figure 2:
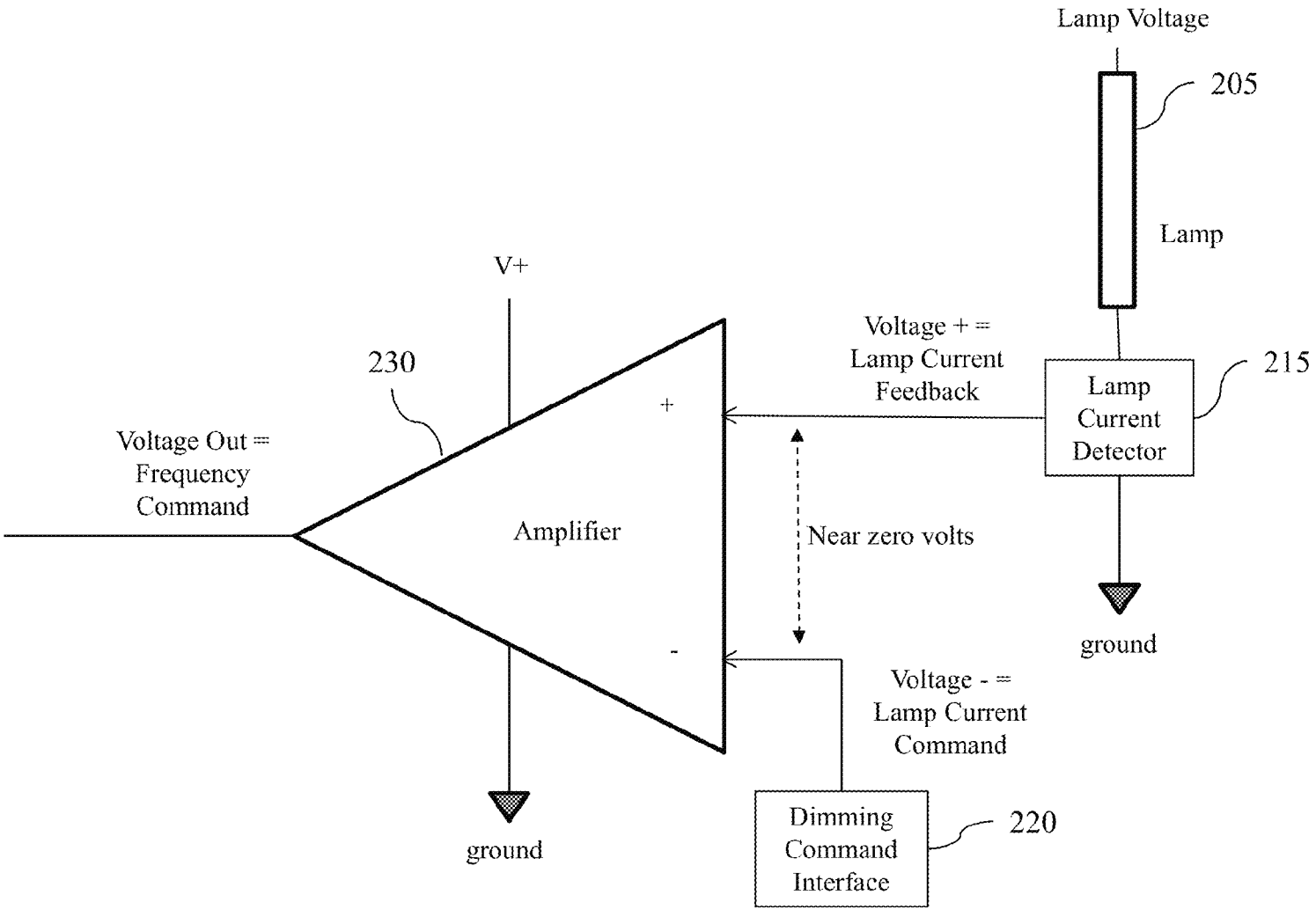
FIG. 2 is an illustration of an embodiment of a portion of the current control loop of the lighting system of FIG. 1A, during normal operation.
Figure 3:
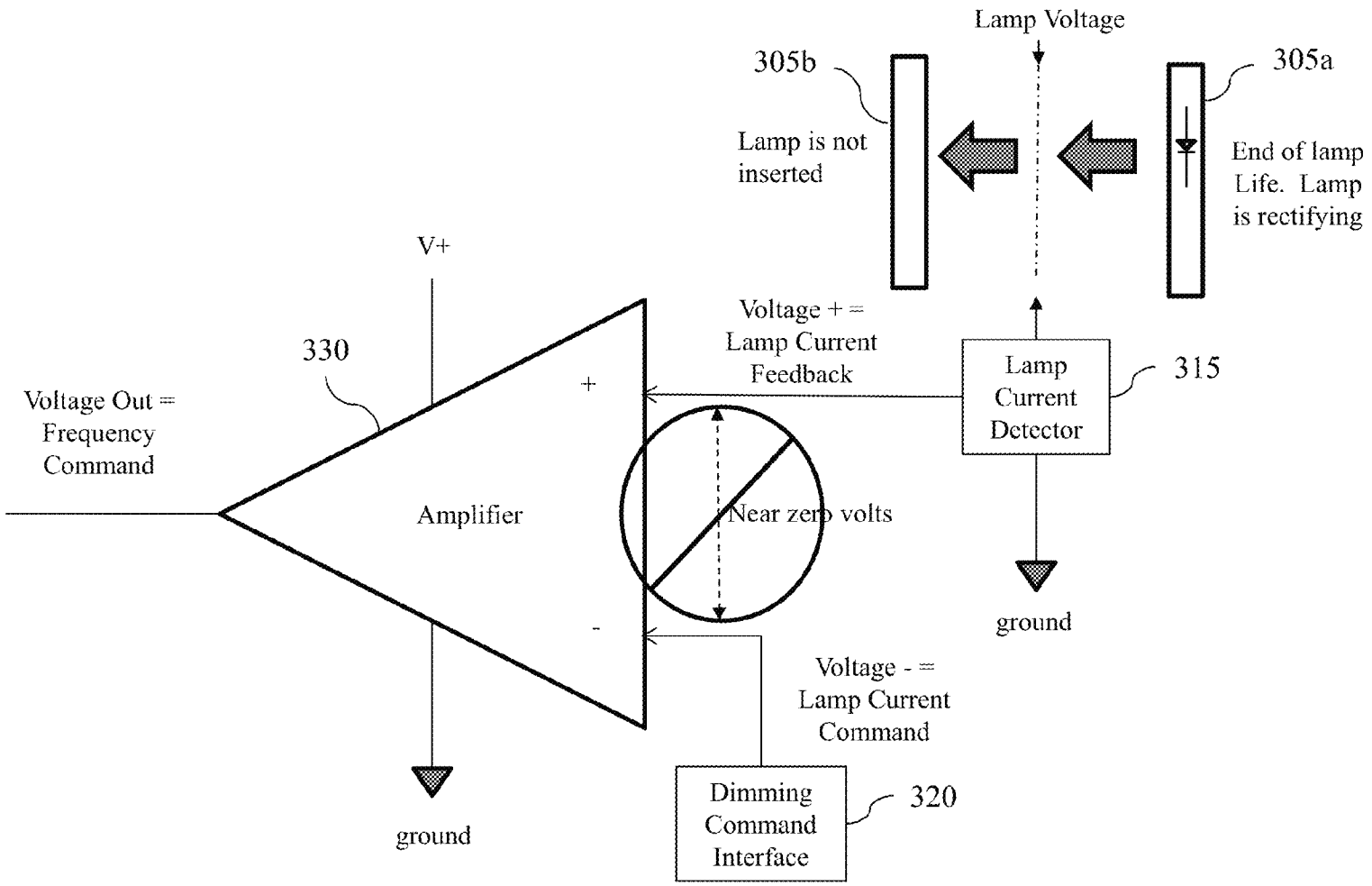
FIG. 3 is an illustration of a portion of the current control loop of FIG. 1A, during fault conditions.

FIGS. 2 and 3 depict embodiments of the amplifier output in accordance with the embodiments as discussed above with respect to FIG. 1. FIG. 2 is an illustration of a differential amplifier 230 during normal operating conditions. FIG. 3 is an illustration of an amplifier 330 during fault conditions.

As shown in FIG. 2, the amplifier 230 can be, for example, a differential amplifier that receives two voltage inputs, e.g., a positive (+) input and a negative (−) input, from a current detector 215 and a dimming command interface 220. Current through lamp 205 is detected by lamp the current detector 215. The current detector 215 outputs a voltage, i.e., the lamp current feedback voltage, to the positive input of the amplifier 230. The dimming command interface 220 outputs a voltage, i.e., a lamp current command voltage, to the negative input of the amplifier 230. The amplifier 230 provides an amplified single output of the difference between the two input voltages to the frequency controller of the ballast inverter 110.

Under normal operating conditions, as shown in FIG. 2, the current loop will force near zero volts across both inputs of the amplifier 230, i.e., the positive input and the negative input. The lamp current feedback (detected by the current detector 215) will equal the lamp current command (set by the dimming command interface 220). Under these conditions, the current control loop is said to be closed. The amplifier Voltage Out will be a positive voltage much greater than 0V. The Voltage Out is provided to the frequency controller (not shown) in order to set the Frequency Command such that the light or dimming level of the lamp 205 is effectively set.

FIG. 3 is an illustration of the amplifier of FIG. 1, during fault conditions. During fault conditions, the lamp current feedback will not equal the lamp current command. For example, a fault condition may be created when a lamp 305*a* is inserted in the ballast 100 but the lamp 305*a* is at the EOL (e.g., the lamp is rectifying), or when a lamp 305*b* is not inserted in the ballast 100. These conditions create insufficient lamp current, as detected by a current detector 315.

When there is insufficient lamp current, the input to amplifier 330 by a dimming command interface 320, i.e., the lamp current command (at the negative (−) input of amplifier 330), will be greater than the input to the amplifier 330 by the current detector 315, i.e., the lamp current feedback (at the positive (+) input of amplifier 330). Under these conditions, the amplifier Voltage Out will saturate to the minimum output voltage of the amplifier 330, i.e., zero volts (0V). An open loop detector 140 recognizes zero volts at the output of amplifier 330 as an abnormal value. As discussed above, for example, with respect to FIG. 1, the open loop detector sends a signal to a frequency controller 112 in order to set the Frequency Command such that the hazard presented by the fault condition is mitigated.

Figure 4:
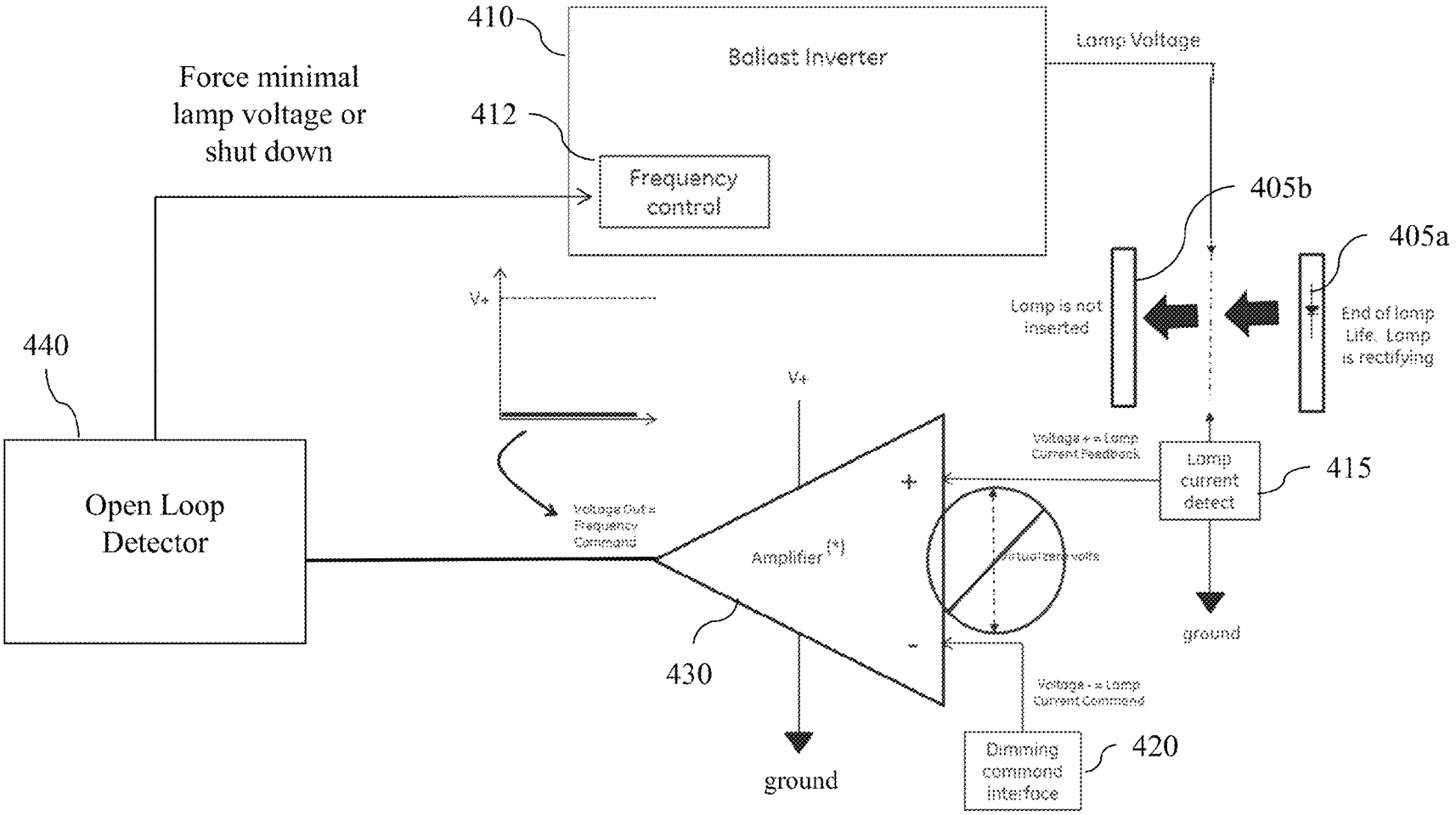
FIG. 4 is a schematic diagram of an embodiment of an open loop detector of the lighting system of FIG. 1A, during fault conditions.

FIG. 4 is a block diagram illustration of an embodiment of an open loop detector in accordance with the embodiment of FIG. 1. An open loop detector 440 receives the Voltage Out signal from an amplifier 430. During fault conditions, as discussed above with respect to FIG. 3, the positive (+) input of amplifier 430 received from current detector 415 cannot equate to the negative (−) input received from dimming command interface 420, and the larger negative (−) input will drive the output of amplifier 430 to zero volts (0V). Under these conditions, open loop detector 440 detects that the lamp current control loop is open, which indicates an EOL condition of the lamp 405*a*, i.e., the lamp is rectifying, or an open circuit condition at lamp 405*b*, i.e., no lamp is inserted. The open loop detector 440 sends a control to frequency controller 412 forcing the ballast inverter 410 to output a minimal, safe voltage or to shut down.

Further, referring back to FIG. 1, anytime the lamp in embodiments of the present invention is started, the current control loop 102 remains open until the lamp 105 ignites and reaches a steady state at which time the current control loop 102 closes. This could ordinarily cause a false triggering of the open loop detector 140 and similarly open loop detector 440. However, the disable circuit 150, via switch 160, disables the setting of the open loop detector 140 under conditions of power-up starts or maintenance/lamp replacement starts. One of the benefits of this approach is that it prevents the false triggering of the open loop detector 140.

Figure 5:
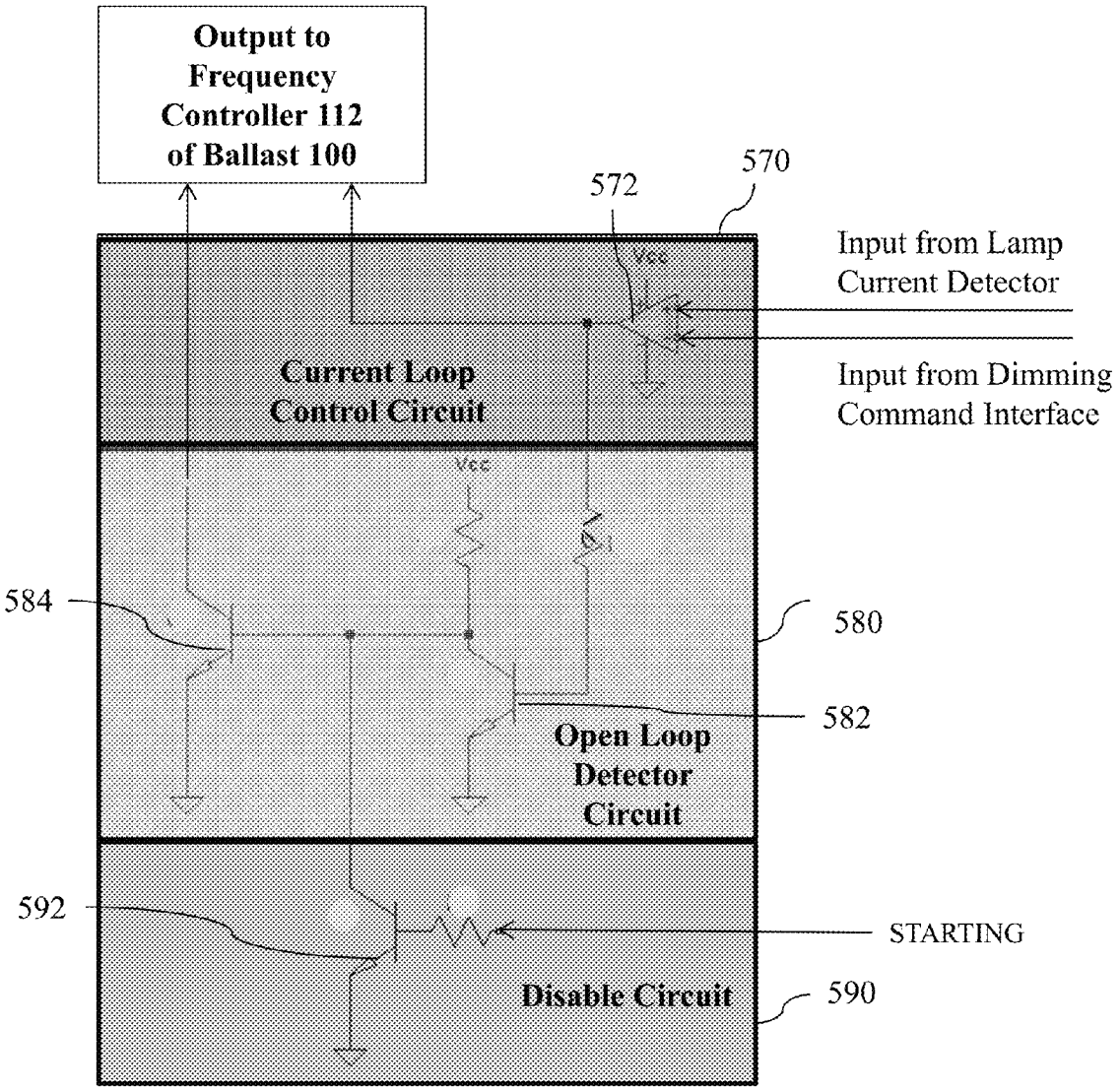
FIG. 5 is a schematic diagram of the lighting system embodiment shown in FIG. 1A.

FIG. 5 is a schematic diagram of an exemplary circuit 500 of the dimming ballast 100 of FIG. 1. The circuit 500 includes a current loop circuit 570, an open loop detector circuit 580, and a disable circuit 590. During normal operation, when the current control loop is closed, a transistor (switch) 584 is turned OFF and transistor (switch) 582 is turned ON by the Voltage Out of an amplifier 572. Transistor switch 584 being OFF allows the frequency controller 112 of ballast 100 to output a frequency in accordance with the Voltage from amplifier 572. The starting signal of a disable circuit 590 would be low and would have no effect on the open loop detector circuit 580.

During an open loop condition, the transistor 584 is turned ON and the transistor 582 is turned OFF due to zero volts (0V) at Voltage Out of the amplifier 572. The transistor 584 low signal is output to the frequency controller 112 and causes the frequency controller to output a minimal lamp voltage. The starting signal of the disable circuit 590 would be low. The ballast 100 remains in this condition because the output of amplifier 572 will not change states due to the near zero current at the lamp, caused by the low signal output from transistor 584 to the frequency controller. The ballast 100 must be power cycled, or a new lamp 105 inserted, to initiate a starting cycle to clear the fault state of the ballast. During starting of the lamp, transistor 584 is held OFF and transistor 592 is turned ON via the starting signal. With the transistor 584 turned OFF, the amplifier 572 has full control of the frequency controller.

Figure 6:
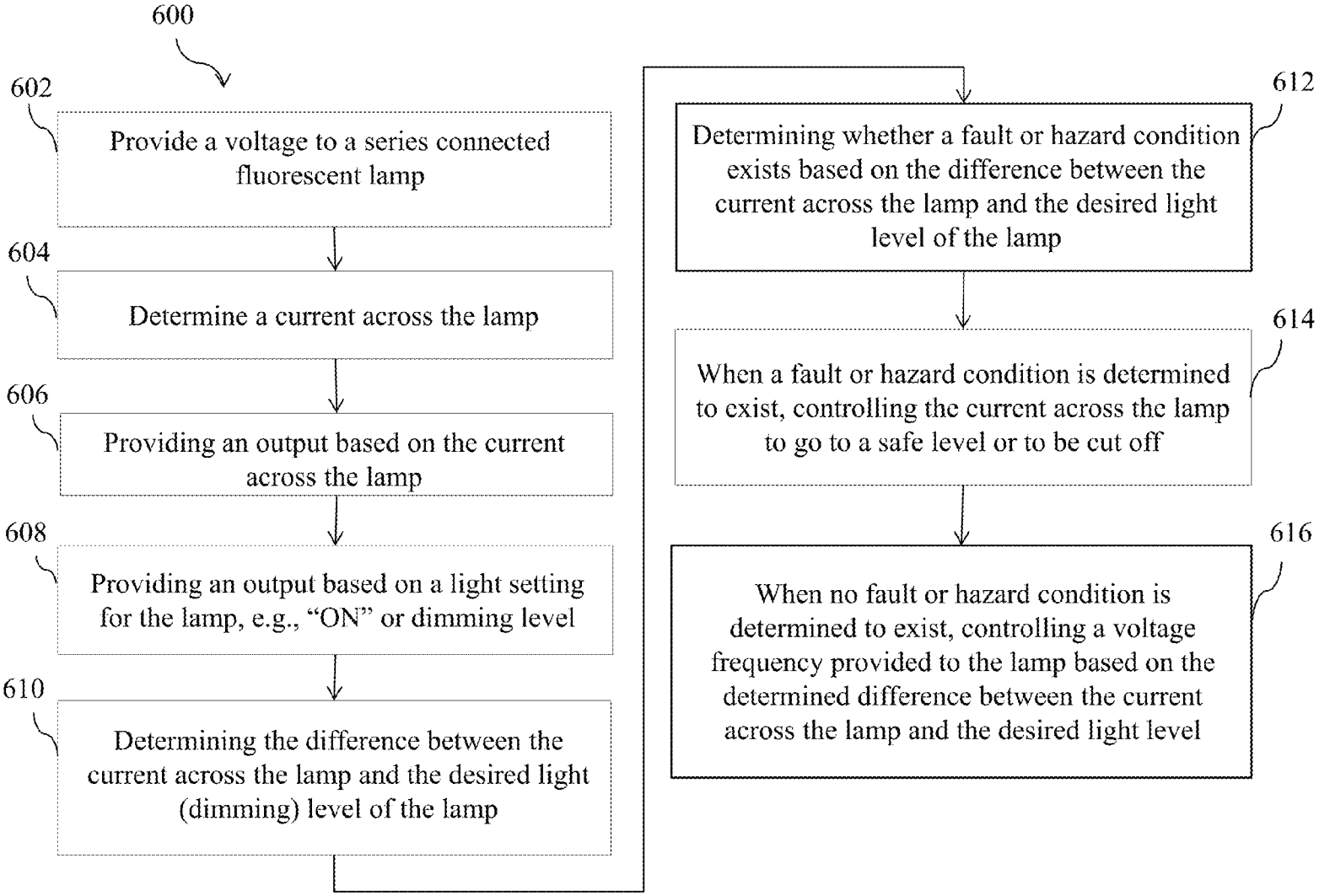
FIG. 6 is a flowchart of an exemplary method of practicing an embodiment of the present invention.

FIG. 6 is flowchart of an exemplary method 600 of practicing an embodiment of the present invention. The method 600 provides for controlling the light level (dimming or brightness) of a fluorescent lamp in accordance with the embodiment. The method 600 beings at step 602 by providing a voltage to a fluorescent lamp. The fluorescent lamp may include two series connected fluorescent lamps. At step 604, the current across the lamp is determined. At step 606, an output of the current across the lamp is provided.

At step 608, an output is provided based on a light setting, e.g., the lamp being turned to an on position. The light setting may also indicate a desired light (brightness or dimming) level of the lamp. At step 610, the difference between the current across the lamp and the desired light level of the lamp is determined. At step 612, the existence of a fault or hazard condition is determined based on the difference between the current across the lamp and the desired light level of the lamp. At step 614, when a fault or hazard condition is determined to exist, the current across the lamp is controlled to go to a safe level or to be cut off.

The fault or hazard condition may be, for example, a high voltage at the lamp or a low current through the lamp. Cutting off or controlling the current across the lamp to a safe level mitigates the hazard by reducing the risk of shock. Cutting off or controlling the current to a safe level also improves the efficiency of the dimming ballast. At step 616, when no fault or hazard condition is determined to exist, the voltage frequency provided to the lamp is controlled based on the determined difference between the current across the lamp and the desired light level.

Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

We claim:

1. The lighting method, comprising:

providing a voltage to a lamp, the lamp comprising fluorescent lamps;

determining a current across the lamp;

providing an output based on the current across the lamp;

providing an output based on a light setting, wherein the light setting may indicate a desired light level of the lamp;

determining a difference between the current across the lamp and the desired light level of the lamp;

determining whether a fault or hazard condition exists based on the difference between the current across the lamp and the desired light level;

controlling, when a fault or hazard condition is determined, the current across the lamp to go to a safe level or to be cut off; and controlling, when no fault or hazard condition is determined, a voltage frequency applied to the lamp based on the determined difference between the current across the lamp and the desired current level.

2. The lighting method according to claim 1, wherein the desired light level is a dimming level of the lamp, and the voltage frequency applied to the lamp determines the dimming level.

3. A lighting system for controlling operation of a lamp, comprising:

a summing junction configured to output at least a first signal representative of a lamp operating condition;

a detector configured for producing a control signal as an output when the first signal is received as an input thereto; and a current limiting device configured to receive the control signal and output a limiting signal to a first terminal of the lamp when the control signal is received;

wherein a second terminal of the lamp is configured for coupling, at least indirectly, to a first terminal of the summing junction.

4. The lighting system of claim 3, further comprising a current detector having an input port configured for coupling to second terminal of the lamp and an output port coupled to the first terminal of the summing junction.

5. The lighting system of claim 4, further comprising a dimming control interface coupled to a second terminal of the summing junction.

6. The lighting system of claim 3, wherein the summing junction is configured for comparing a lamp current signal output from the current detector and a level setting signal output from the dimming control interface to produce the first signal.

7. The lighting system of claim 6, wherein the first signal is representative of a fault condition.

8. The lighting system of claim 7, wherein the fault condition includes an open loop condition of the lighting system.

9. The lighting system of claim 6, wherein the current limiting device includes a frequency controller for controlling a voltage across the lamp;

wherein the lamp current signal is responsive to the voltage.

* * * * *

UNITED STATES PATENT AND TRADEMARK OFFICE

CERTIFICATE OF CORRECTION

PATENT NO. : 9,078,307 B2
APPLICATION NO. : 13/723281
DATED : July 7, 2015
INVENTOR(S) : Yao et al.

It is certified that error appears in the above-identified patent and that said Letters Patent is hereby corrected as shown below:

On the Title Page, item (72), under "Inventors", in Column 1, Line 2, delete "Domenic" and insert -- Dominic --, therefor.

Signed and Sealed this
First Day of December, 2015

Michelle K. Lee

Michelle K. Lee
*Director of the United States Patent and Trademark Office*